US008132871B1

(12) United States Patent
Caruso

(10) Patent No.: US 8,132,871 B1
(45) Date of Patent: Mar. 13, 2012

(54) STORAGE SYSTEM

(76) Inventor: Steven Jerome Caruso, Antioch, IL (US)

( * ) Notice: Subject to any disclaimer, the term of this patent is extended or adjusted under 35 U.S.C. 154(b) by 761 days.

(21) Appl. No.: 11/647,697

(22) Filed: Dec. 30, 2006

Related U.S. Application Data

(63) Continuation-in-part of application No. 10/628,524, filed on Jul. 26, 2003, now abandoned.

(60) Provisional application No. 60/398,916, filed on Jul. 27, 2002.

(51) Int. Cl.
*A47B 81/00* (2006.01)
*A47B 73/00* (2006.01)

(52) U.S. Cl. ..... 312/310; 312/300; 312/116; 211/74; 211/169

(58) Field of Classification Search ..... 312/116, 312/120, 125, 128, 133, 136, 294, 300, 309, 312/310, 326, 295; 211/74, 75, 77, 81, 168, 211/169
See application file for complete search history.

(56) References Cited

U.S. PATENT DOCUMENTS

| | | | | | |
|---|---|---|---|---|---|
| 352,614 | A | * | 11/1886 | Fashing | 312/138.1 |
| 452,594 | A | * | 5/1891 | Charles | 312/300 |
| 622,195 | A | * | 4/1899 | Allison | 312/199 |
| 749,741 | A | * | 1/1904 | Martin | 217/19 |
| 846,121 | A | * | 3/1907 | Matthews, Jr. | 312/136 |
| 1,227,799 | A | * | 5/1917 | Kaub | 312/300 |
| 1,454,985 | A | * | 5/1923 | Tate | 312/300 |
| 1,616,085 | A | * | 2/1927 | Heath | 312/116 |
| 1,723,460 | A | * | 8/1929 | Beare | 62/332 |
| 1,731,746 | A | * | 10/1929 | Hunter | 312/300 |
| 2,092,430 | A | * | 9/1937 | Stratton | 312/298 |
| 2,104,939 | A | * | 1/1938 | Whalen | 312/302 |
| 2,928,555 | A | * | 3/1960 | Childs et al. | 211/169 |
| 3,028,208 | A | * | 4/1962 | Sharpe | 312/223.5 |
| 3,379,484 | A | * | 4/1968 | Kling | 312/300 |
| 3,726,415 | A | * | 4/1973 | Malik | 211/169 |
| 3,760,952 | A | * | 9/1973 | White | 211/168 |
| 3,804,482 | A | * | 4/1974 | Smith | 312/236 |
| 4,276,984 | A | * | 7/1981 | Simmons | 211/81 |
| 4,569,448 | A | * | 2/1986 | Graham | 211/74 |
| 5,740,910 | A | * | 4/1998 | Ueng | 206/373 |
| 6,991,117 | B2 | | 1/2006 | McCain | |
| 7,850,017 | B2 | | 12/2010 | McCain | |

* cited by examiner

*Primary Examiner* — James O Hansen
(74) *Attorney, Agent, or Firm* — McAndrews, Held & Malloy, Ltd.

(57) ABSTRACT

The disclosed invention provides an improved means of storing and retrieving bottles of wine, other bottles of fluid, or other items. The invention provides for the labels of the bottles/items to be easily viewed. Additionally, the invention yields a format that allows the bottles/items to be stored in the limited depth afforded in cabinets normally used above kitchen counters. Another aspect of this invention is directed at, but not limited to, the use a refrigeration system to keep these items at the proper storage temperature. And so this invention relates to both an isolated storage system, and to that would be used in conjunction with a cooling/environmental chamber. So this invention presents a new method for the storage, display, and retrieval of bottles/items that is suitable for use at a plurality of heights, and additionally may either be a freestanding system or used within another structure such as a home cabinet, refrigerated or not.

24 Claims, 12 Drawing Sheets

STORAGE SYSTEM

CROSS REFERENCE TO RELATED APPLICATIONS

Note: This is a Continuation In Part U.S. application Ser. No. 10/628,524 filed Jul. 26, 2003, now abandoned. That application, and thus this application claims the benefit of U.S. Provisional Application No. 60/398,916, filed Jul. 27, 2002. The entire disclosure of both applications are hereby incorporated herein by reference.

FIELD OF THE INVENTION

The present invention relates generally to the storage of bottles or other items in a more efficient manner. Such a storage system could be a stand-alone unit or part of a larger system, which may or may not include a cooling system for the storage system.

BACKGROUND OF THE INVENTION

In the art of item storage and more specifically, bottle storage several systems are known that provide for the storage and retrieval of wine or other fluids contained within a bottle, several of which also include the ability to store the bottles in a predominantly horizontal nature, thus ensuring that the fluids contained within are preserved in an appropriate manner, for example keeping the cork of a bottle of wine moist. It is also common knowledge to use a refrigeration system to keep such perishable items at an appropriate temperature for proper storage.

There are limitations to the existing methods though. Either the format is only conducive/suitable for larger-scale storage, because the system is not maximized for efficiency, the bottles or items to be stored are not displayed in a visually appealing way, or the bottles/items are difficult to identify and thus retrieve.

SUMMARY OF THE INVENTION

The present invention is intended to provide an improved means of storing, viewing and retrieving various items, however the disclosure is directed more specifically at the storage viewing and retrieval of bottles of wine or other bottles of fluid. The invention provides for the labels of the bottles to be easily viewed. The invention also utilizes space more efficiently than known systems. Additionally, the invention yields a format that allows the bottles to be stored in the limited depth afforded in cabinets normally used above kitchen counters. Another aspect of this invention is directed at, but not limited to, the use a refrigeration system to keep these items at the proper storage temperature. And so this invention relates to both an isolated storage system, and to that would be used in conjunction with a cooling/environmental chamber.

REFERENCE CHARACTERS USED

Figure 1:
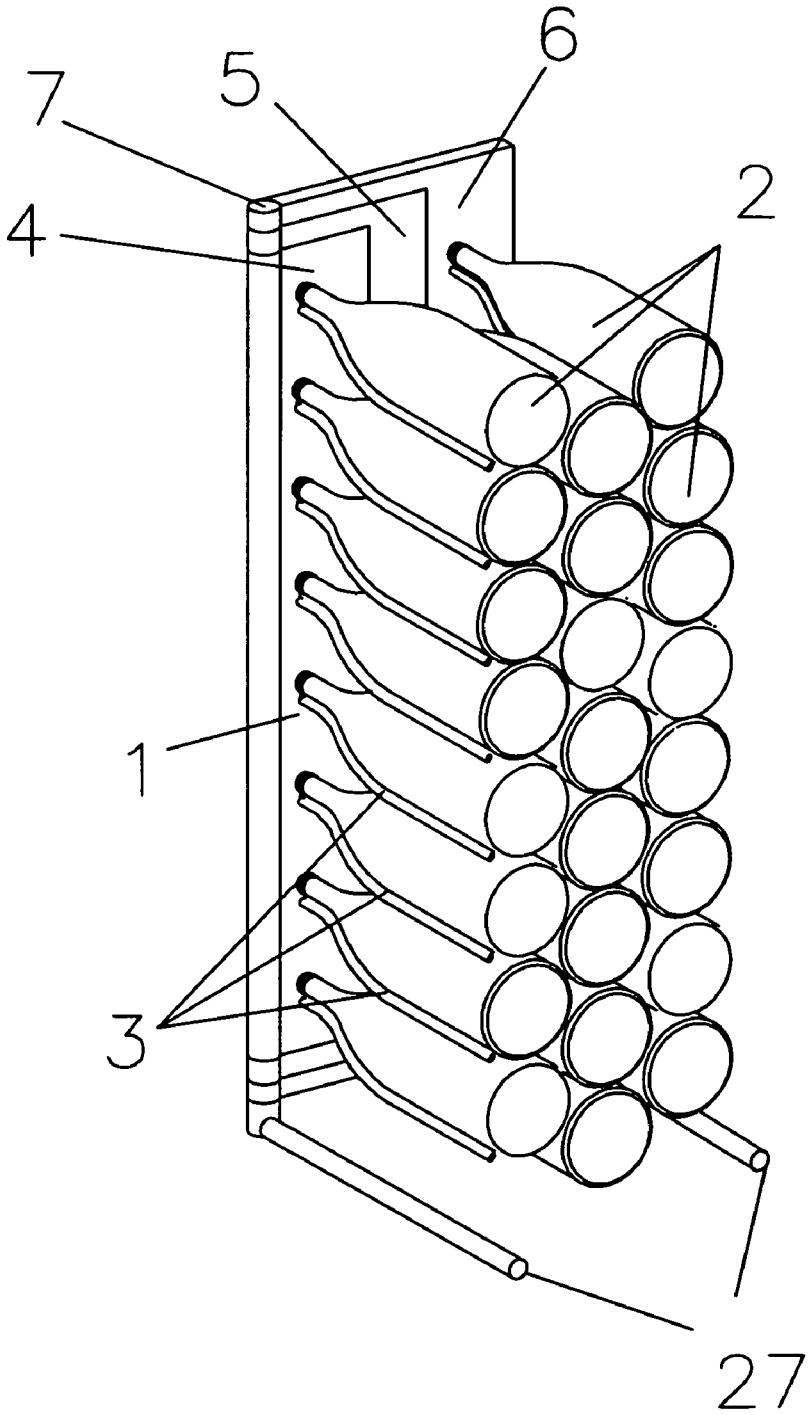
FIG. 1 is a trimetric view illustrating the operating principles of the invention.

The following reference characters are used in the drawings of refer to the parts of the present invention. Like reference characters indicate like or corresponding parts in the respective views.

1—Storage structure
2—Bottle(s)
3—Support rails/support structure means
4—Hinged leaf
5—Hinged leaf
6—Hinged leaf
7—Hinge pivot point
8—Hinged leaf
9—Hinged leaf
10—Hinged leaf
11—Hinged leaf
12—Hinged leaf
13—Hinged leaf
14—Hinge of 11
15—Hinge of 12
16—Hinge of 13
17—Pivot point
18—Pivot point
19—Pivot point
20—Is the arc of bottle 23 if it were to use pivot 19
21—Arc is the arc of bottle 23 if it were to use pivot 18
22—Arc is the arc of bottle 23 if it were to use pivot 17
23—Column/leaf of 19
24—Column/leaf of 18
25—Column/leaf of 17
26—Opposing racking system
27—Support legs
28—Cabinet structure/Climate Controlled Cabinet/Cabinet Liner Insert Structure
29—Door of 28
30—"L" bracket panel
31—Mounting holes of 30
32—Various items to be stored
33—Climate Control Means
34—End view circumference outline of a larger bottle
A-A-Plane

DETAILED DESCRIPTION OF THE INVENTION

While the invention will be described in connection with several preferred embodiments, it will be understood that the invention is not limited to these embodiments. On the contrary, the invention includes all alternatives, modifications, and equivalents as may be included within the spirit and scope of the disclosure. Although the present invention is directed at an improved means of the storage, viewing and retrieval of bottles of wine or other bottles of fluid, other items of storage are contemplated.

In the art of storage, more specifically wine bottle storage, several systems are known that provide for the storage and retrieval of wine bottles. Most of the time the bottles are stored in a predominantly horizontal nature, thus ensuring that the fluids contained within are preserved in an appropriate manner, for example keeping the cork moist. Most of these systems fall into one of three categories, the "pidgin hole" approach, the "bin" approach or the "tray" approach.

The pidgin hole approach involves creating a series of openings or holes in a structure which cradle or otherwise support the bottles to be stored. These structures are often created out of wood or metal wire and come in a variety of styles. The problem with this system is that seeing the labels in order to select a particular bottle is difficult at best, and often involves removing the bottle in question to properly identify it. This is because either the structure itself blocks the view of the label, or the surrounding bottles themselves block the users view of many of the labels. Additionally, bottles can only be stored at a single depth, in other words one bottle deep, and so a great amount of space is required to store a given number of bottles.

The bin approach is often used to store many of the same type of product in a single bin. Often these bins are set at an angle and stacked so that a few of the items or bottles may be seen. The problem here is obvious in that only a few bottles may be viewed at any one given time, and additionally bottles can only be seen at a plane well below eye level.

The other approach is the tray approach. Often the trays are equipped with drawer-type slides so that the trays, which are stacked one on top of one another, may be pulled out for viewing. The problem with this approach is that when the trays are in their stowed position, only the ends of the bottles are visible, similar to the situation of the pidgin-hole approach. And as in the case of the bin approach, the bottles can only be seen at a plane well below eye level. Also, the bottles must be lifted vertically off the tray, and so this makes it very difficult or impossible to view or retrieve bottles that are to be stored at any appreciable height.

It is also common knowledge to use a refrigeration system to keep wine items at an appropriate temperature for proper storage. This is often referred to as "cellar" storage. Most of these systems use the tray approach in small (non-walk-in refrigerator sized) units and the pidgin hole or bin approach in larger room size installations and suffer the shortcomings of those approaches already discussed. A major shortcoming is that all of the discussed systems store the bottles in an orientation that makes it so the depth of the unit (defined as the distance from a rearward wall) is defined generally by the height of at least one bottle. This dimension alone (the height of one bottle) is usually greater than the depth of standard above counter cabinetry. Because of the shortcomings, most notably the height restrictions on both viewing and access and the orientation just discussed, the solutions to date are not conducive to above-counter or overhead cabinet configurations. So most of the smaller units are made to the depth of counter-clad/below the waist cabinets or approximately 24 inches in the United States. Most of these units also dictate that you store a large quantity of wine, which is often too much storage for many. So what is desired, and this invention addresses, is a new method for the storage, display, and retrieval of wine, or other items, that is suitable for use at a plurality of heights, and in a plurality of situations, large or small, and additionally may either be a freestanding system or used within another structure such as a home cabinet, refrigerated or not.

Referring to FIG. 1, some of the major components of the invention may be seen. The bottles 2, are arranged generally in vertical columns, and the rails 3, support the bottles. Many such structures for supporting bottles are known from the aforementioned rails, to holding the bottle solely by its neck, to a simple platform structure, to a cradling structure. Any of these known methods or arrangements would work with the present invention. Additionally, any of the following embodiments may alternatively support the bottles or items to be stored, in a generally upright position. Additionally, any number of rows and columns could be used depending of the type of storage desired. The supports for the first column are part of sub-structure 4, the supports for the second column are part of sub-structure 5, and the supports for the third column are part of the sub-structure 6. In this embodiment, all three sub-structures share a common pivot axis 7, and each of these "leaves" 4, 5, and 6 may be nested, which will become apparent as we look at figure two. The entire super structure could either be self-supporting through the use of legs 27, or be attached to another structure such as a wall, cabinet, or other structure. In the case of wall mounting, it may be appropriate to provide an "L" bracket so that the unit may be mounted to a wall directly behind the items to be stored.

Figure 2:
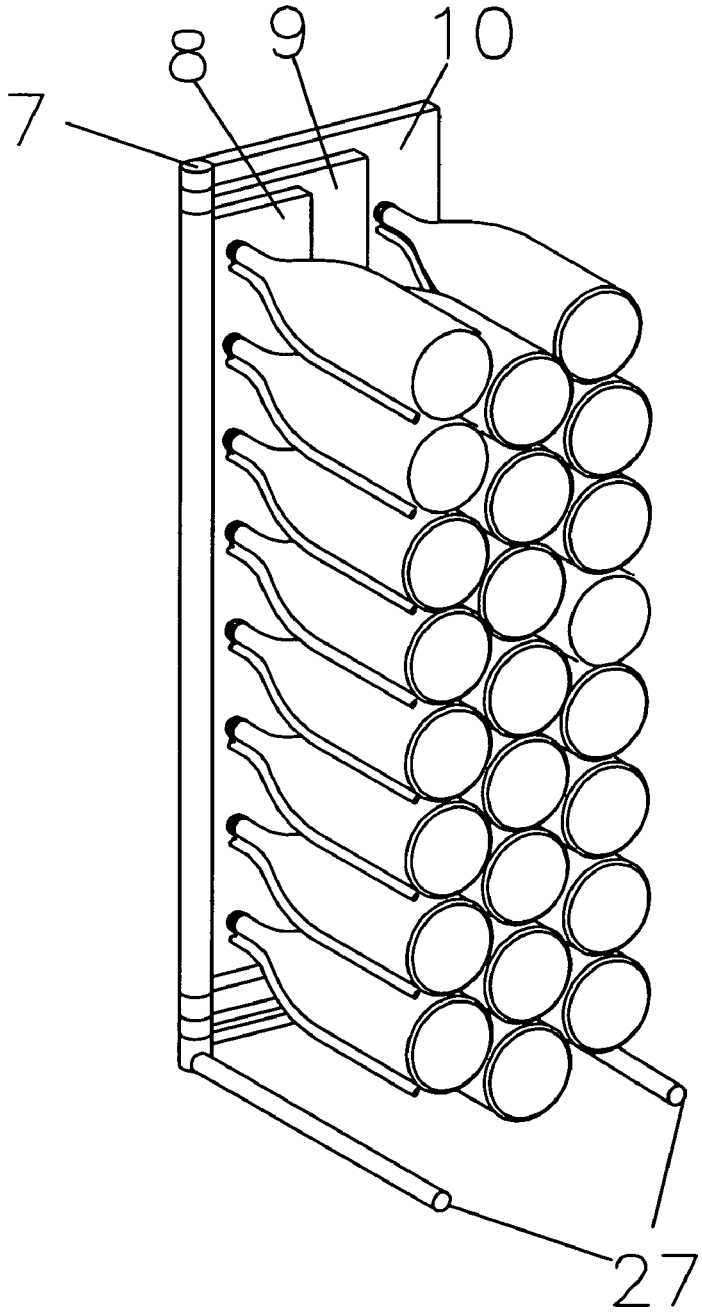
FIG. 2 is another trimetric view further illustrating the operating principles of the invention.
Figure 3:
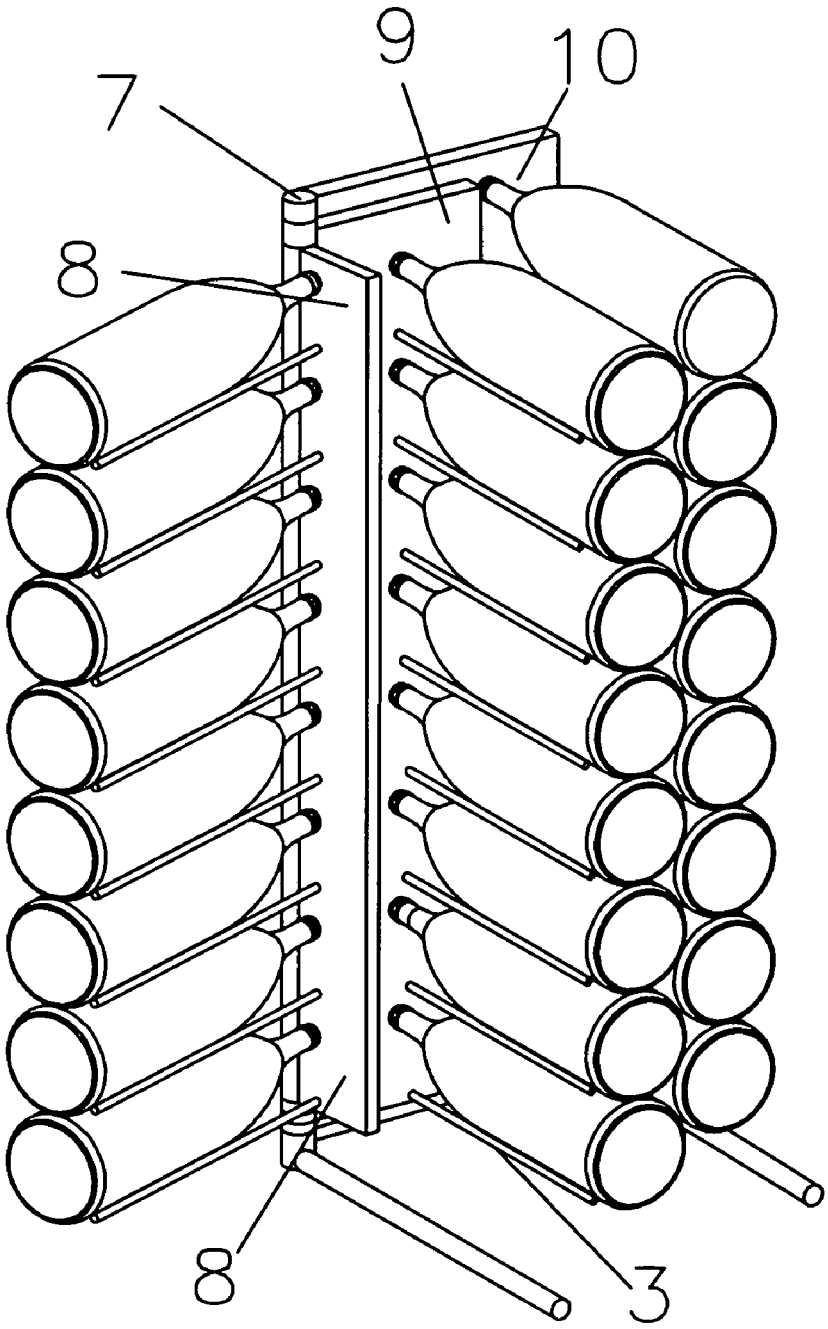
FIG. 3 is a trimetric view further illustrating the operating principles of the invention.
Figure 4:
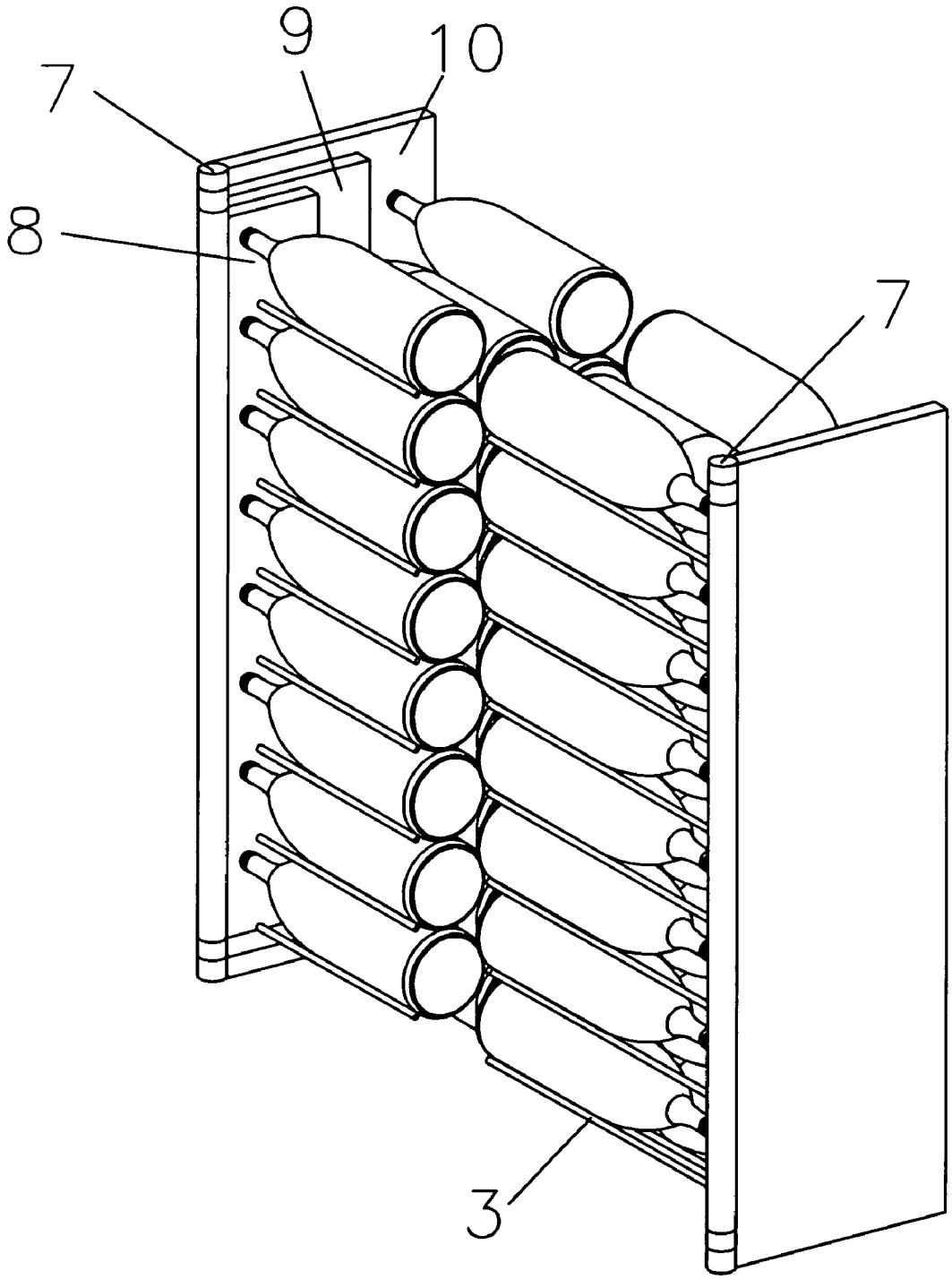
FIG. 4 is a trimetric view further illustrating the operating principles of the invention.

Referring to FIG. 2, a structure much like figure one can be seen. However, leaves 8, 9, and 10 are stacked instead of being nested like the leaves 4, 5, and 6 of FIG. 1. This is considered an alternate arrangement, (though it results in a thicker-stacked profile) and one that clarifies the invention. All of these so called "leaves" in this disclosure could be constructed in a variety of ways from the relatively flat panels depicted to a very open wire structure, so long as the required elements such as bottle supports/pivot(s) and appropriate structure are present. A wire or other generally open configuration may be desirable so that the leaves themselves do not obstruct the users view of the next level when a particular leaf is pivoted 90 degrees or less. Other features described in reference to FIG. 1 are similarly present in the embodiment of FIG. 2, though some are not shown for simplicity. Now referring to FIG. 3, the operation of one embodiment of the invention will become apparent. As in figure one where leaves 4-6 shared pivot point 7, in FIGS. 2 and 3 leaves 8, 9, and 10 share the pivot point 7. It can be seen that leaf 8 has been swung about pivot 7, offering access to the second row of bottles. Similarly, the bottles in the second column may be swung about pivot 7, offering access to the third row. This figure perhaps most clearly demonstrates the uniqueness of the invention. Several bottles may be viewed at once, moved at once, and thus reveal a new layer of bottles/items for clear viewing or access virtually irrespective of the height of the unit relative to its user. In other words, the unit functions in a superior manner, whether situated relatively low near the ground, or higher up, say at eye level or above. Referring to FIG. 4 it can be seen that invention may be used as units next to each other, either directly next to each other, (all bottles could face in the same direction) or opposed as depicted in FIG. 4. An arrangement such as this may be the desirable mode in the situation where the unit is to be used in a cabinet, so that the leaves swing in an arc analogous to the cabinet doors. This is illustrated more clearly by referring to FIG. 7.

Figure 5:
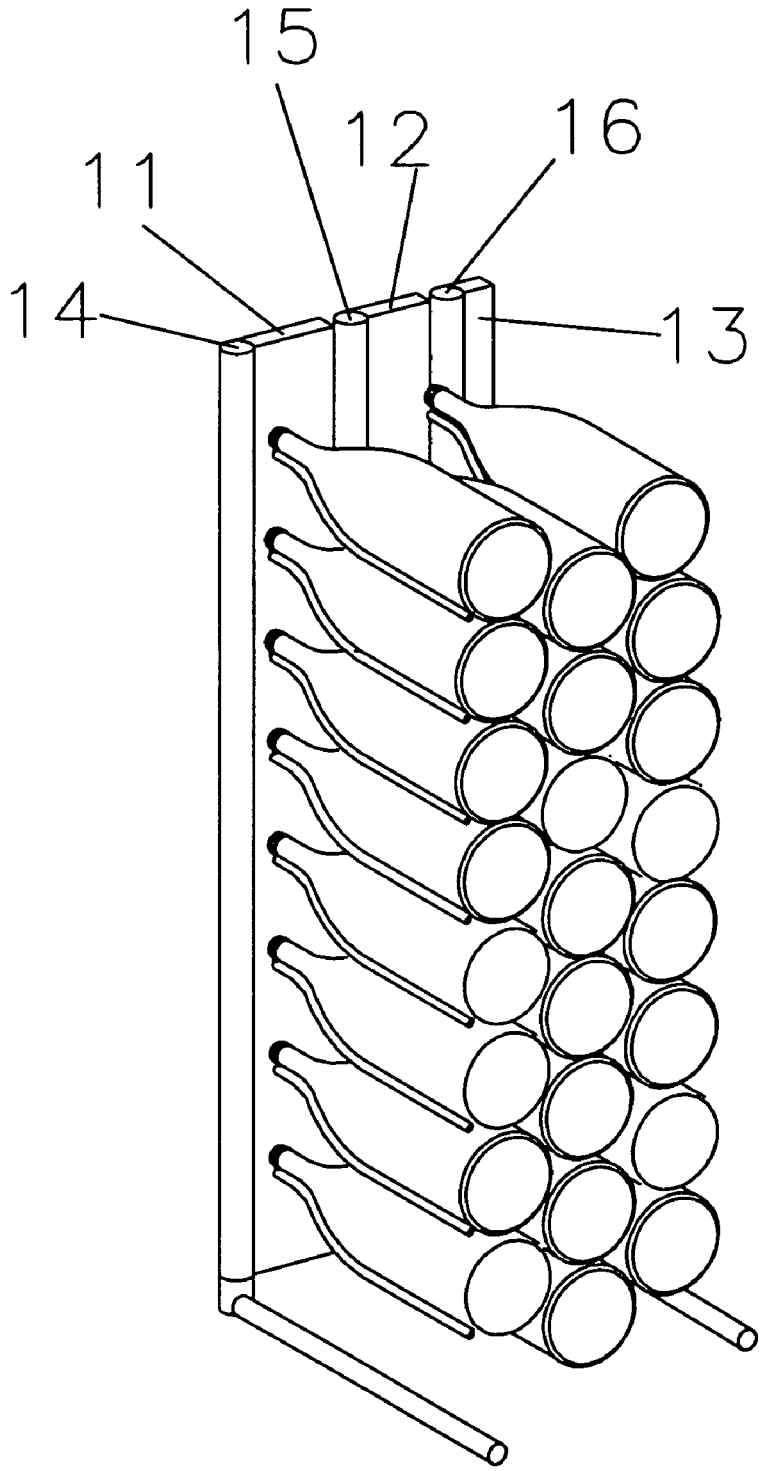
FIG. 5 is a trimetric view further illustrating the operating principles of the invention.
Figure 6:
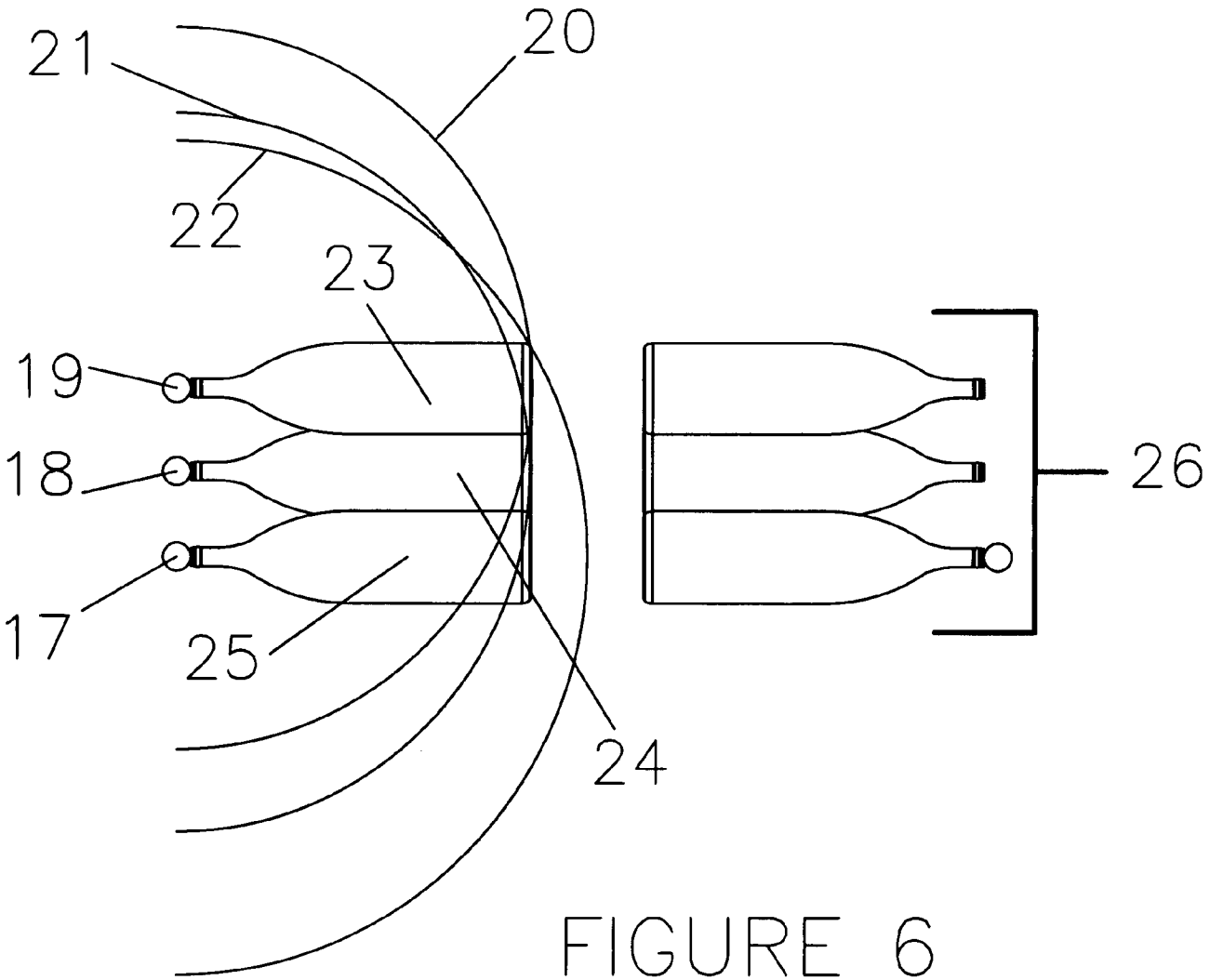
FIG. 6 is a top view further illustrating the operating principles of the invention.

FIG. 5 illustrates another embodiment of the invention. In this case each leaf may have its own pivot axis. As illustrated, leaf 11 has a pivot axis indicated generally by point 14, leaf 12 has a pivot axis indicated generally by point 15, and leaf 13 has a pivot axis indicated generally by point 16. While the previously disclosed method (FIGS. 1-4) of as many leaves as desired sharing the same pivot axis has advantages in certain situations, varying the locations of the leaves, or rows pivot axis, also has its own distinct advantages in other situations. The main advantage of that method disclosed in FIGS. 1-4, is that because the pivot is shared, the "nested" relationship of the bottles, when they are against each other, is the same at any point within their respective movement. The advantages of the embodiment disclosed in FIG. 5 can be appreciated by referring to FIG. 6. FIG. 6 is a schematic top view. In it we can see three-pivot axis 17,18,19 are all positioned generally along the centerline of their respective column or leaf of bottles to be swung, columns 23-25. Arc 22 is the arc swung by bottles/leaf/column 23 if they were to swing about pivot 17, as is the case in previous embodiments. Now note the opposing columns of bottles/racking 26. In order for both racking systems to operate properly, sufficient spacing between the racking systems is necessary to accommodate column 23 swinging about pivot 17. Whereas, if column 23 swings about a more optimized (for this situation) pivot 19 (arc 20) the spacing between this rack and racking 26 can be optimized/minimized. So the choice of pivot locations is variable, and dependant upon the specific situational requirements that are required. It should be appreciated how this system could be used in both smaller installations, and entire walls of units could be created in larger installations, in all cases leading to a vastly improved storage, display and retrieval system.

Naturally, any combination shared and non-shared pivot axis would fall within the spirit and scope of the invention. In other words, again referring to FIG. 5, leaves 11, and 12 could have their own pivot axis, while leaf 13 could share 12*s'* pivot axis etc.

Figure 7:
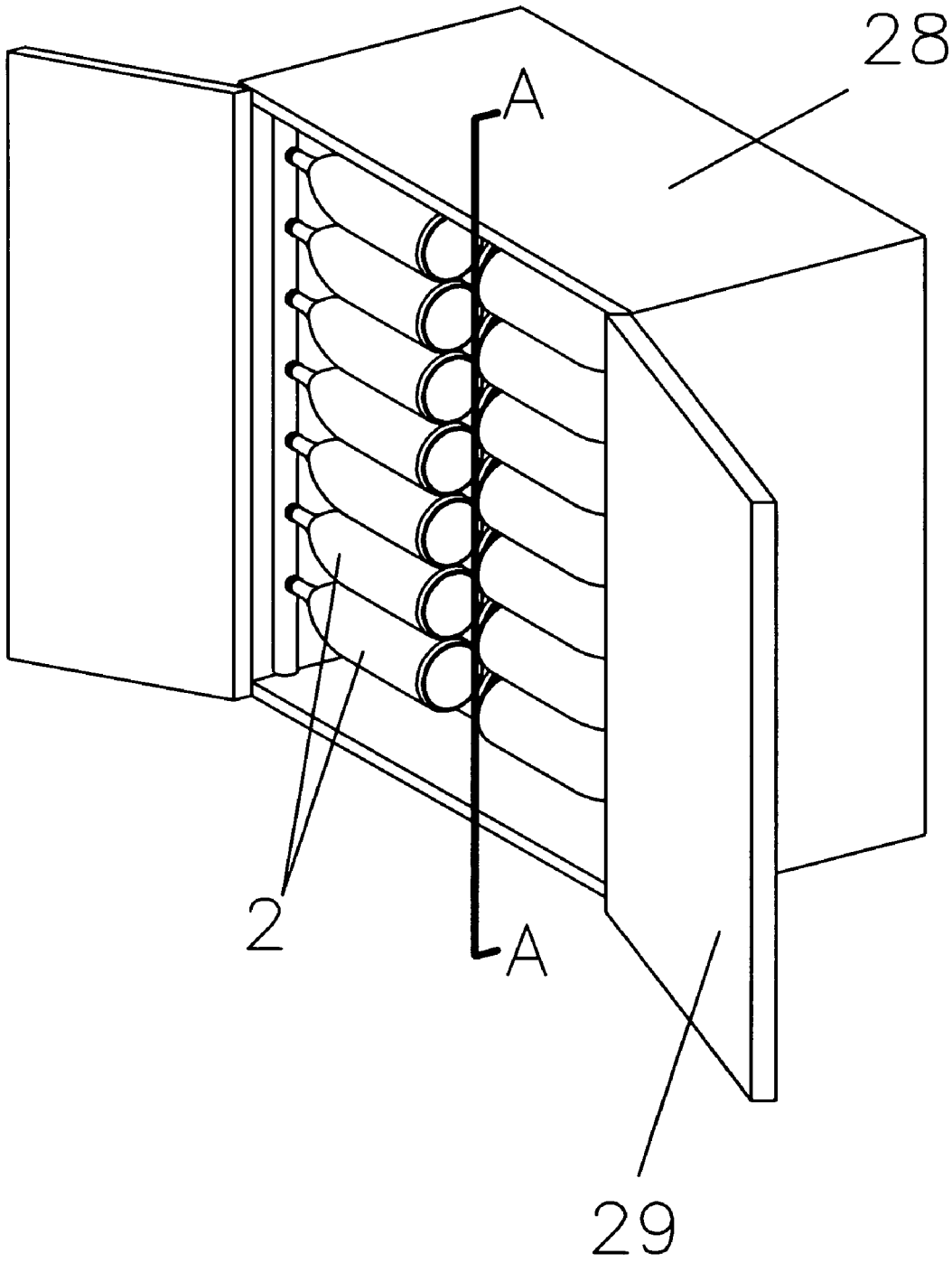
FIG. 7 is a trimetric view further illustrating the invention used in conjunction with a cabinet structure.

Another embodiment of the invention is directed at using the aforementioned storage systems within a cabinet. Referring to FIG. 7 such a cabinet 28, is depicted. As previously mentioned other systems make it very difficult or impossible to view or retrieve bottles that are to be stored at any appreciable height, i.e. above eye level, and so the solutions to date are not conducive to above-counter or overhead cabinet configurations. But this invention addresses this problem by fully exposing the full face of each column or leaf (and thus the labels of the individual bottles), and then allows the user to swing each column or leaf of bottles out of the way, revealing the next successive column or leaf of bottles. Also as previously mentioned, the pivot points are variable in location, number and whether they are shared among the various leaves or columns. So again referring to FIG. 7, the pivot(s) could be located generally on the same plane as the pivot hinges of the doors 29, or one or more could alternatively be located on a plane generally indicated by line A-A, which in this case occurs between two storage systems. The units could be slid into various types of cabinetry, affixed to various types of cabinetry, or constructed as an integral part of various types of cabinetry.

Figure 10:
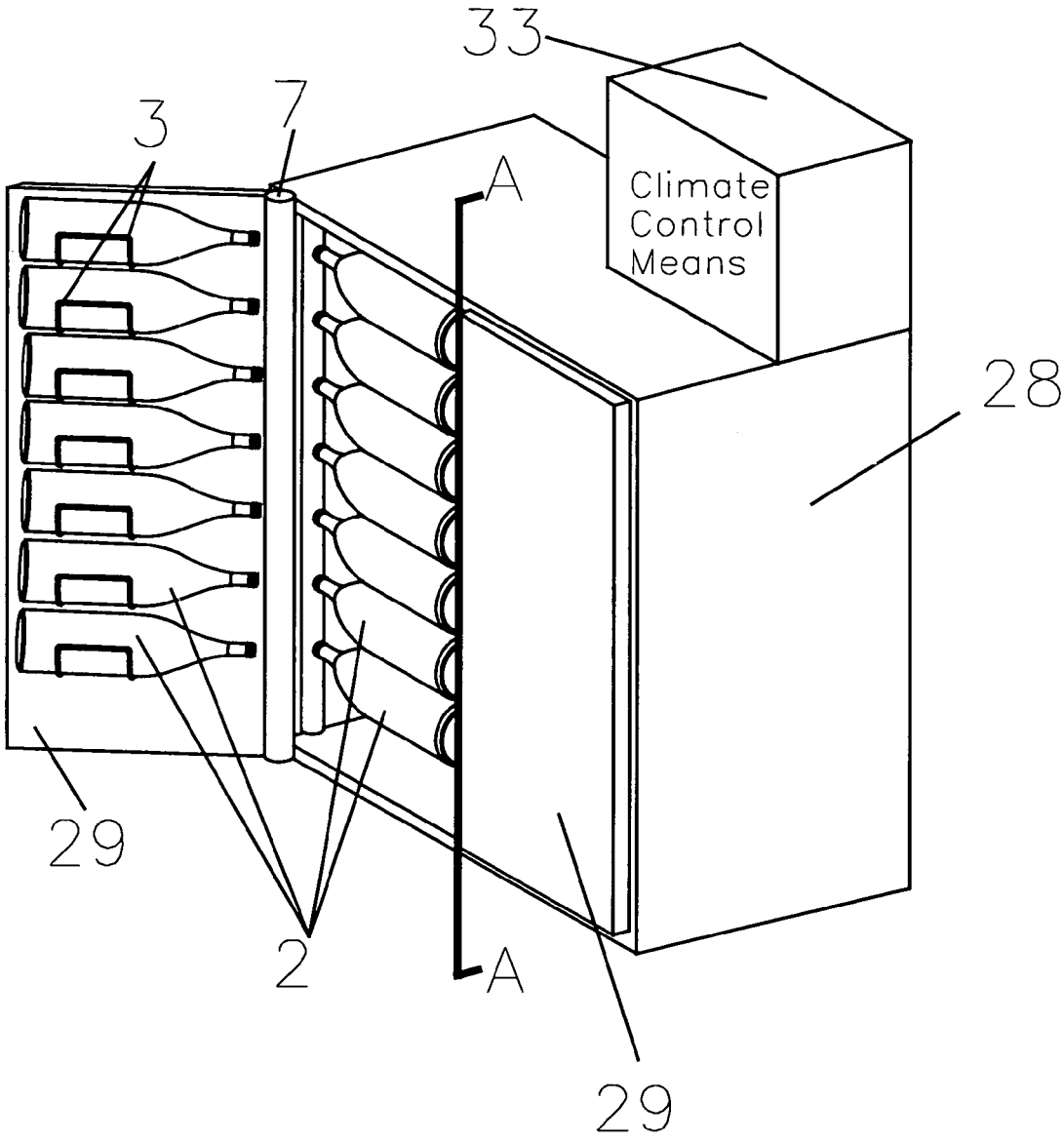
FIG. 10 is a trimetric view further illustrating the invention further showing that one of the pivot points of the device may be the same as the door of a cabinet.

Yet another embodiment of the invention is directed at using the aforementioned storage systems within a climate-controlled cabinet. Such a system could be a completely self-contained situation well known in the industry or a component system that could be installed in customized fashion. The self-contained system could be a complete climate controlled unit with a door or doors which may or may not have glass viewing panels for viewing the cabinets contents. The climate control could be comprised of known cooling methods either thermoelectric/peltier or conventional evaporative gas (freon is one such known gas) technology for keeping the contents at a proper storage temperature. Additionally, the climate control could include the ability to heat the interior and thus contents of the cabinet should the ambient temperature of the cabinets' surroundings become too cool for the contents proper storage. And it is also envisioned that humidity and other environmental factors could be controlled within the cabinet to properly store its contents. This climate control system could be contained within the common dimensions of cabinets, or could be occur above, below, to the side behind etc, or remotely (in another location, connected only by conduit) to the cabinet as is shown in FIGS. 7 and 10. Such a cabinet could also include interior lighting glass insulated doors, and the interactive ability to control the climate.

The component system could be comprised of one or more of the following components: an insulated box or insulated liner insert structure that could be suited to fit within a semi-standard cabinet, a self contained cooling module either thermoelectric/pettier or conventional evaporative gas (freon is one such known gas) technology, interior lighting and insulated doors.

The insulated liner insert structure could be sized to fit into commonly sized cabinets, or itself be a finished unit. If a cabinet were used, a breach in the cabinet may be required for the cooling modules hot side. Its front face could form the sealing surface for the door assembly.

The cooling module ideally would be a self-contained in that it is a "single unit". This would provide easy and economical assembly; easy serviceability and it could be mounted in a variety of locations on/within the unit.

The doors could either be a part of the unit as in conventional cooling systems or glass pack door viewing windows and seals could be provided to be used with a cabinet manufacturers door assemblies. Such assemblies/subassemblies could then be assembled into a cabinet manufacturers door assemblies, providing both an insulating viewing window and a seal between the door and the cabinet. If the doors were part of the unit, and for aesthetic reasons, using a cabinet manufacturers doors as a finish-clad surface was desired, a door on door approach could be used. A sliding joint between the two doors could be used to accommodate the variance in swing of the two doors, yet permit the two doors to generally cooperate as one.

Figure 8:
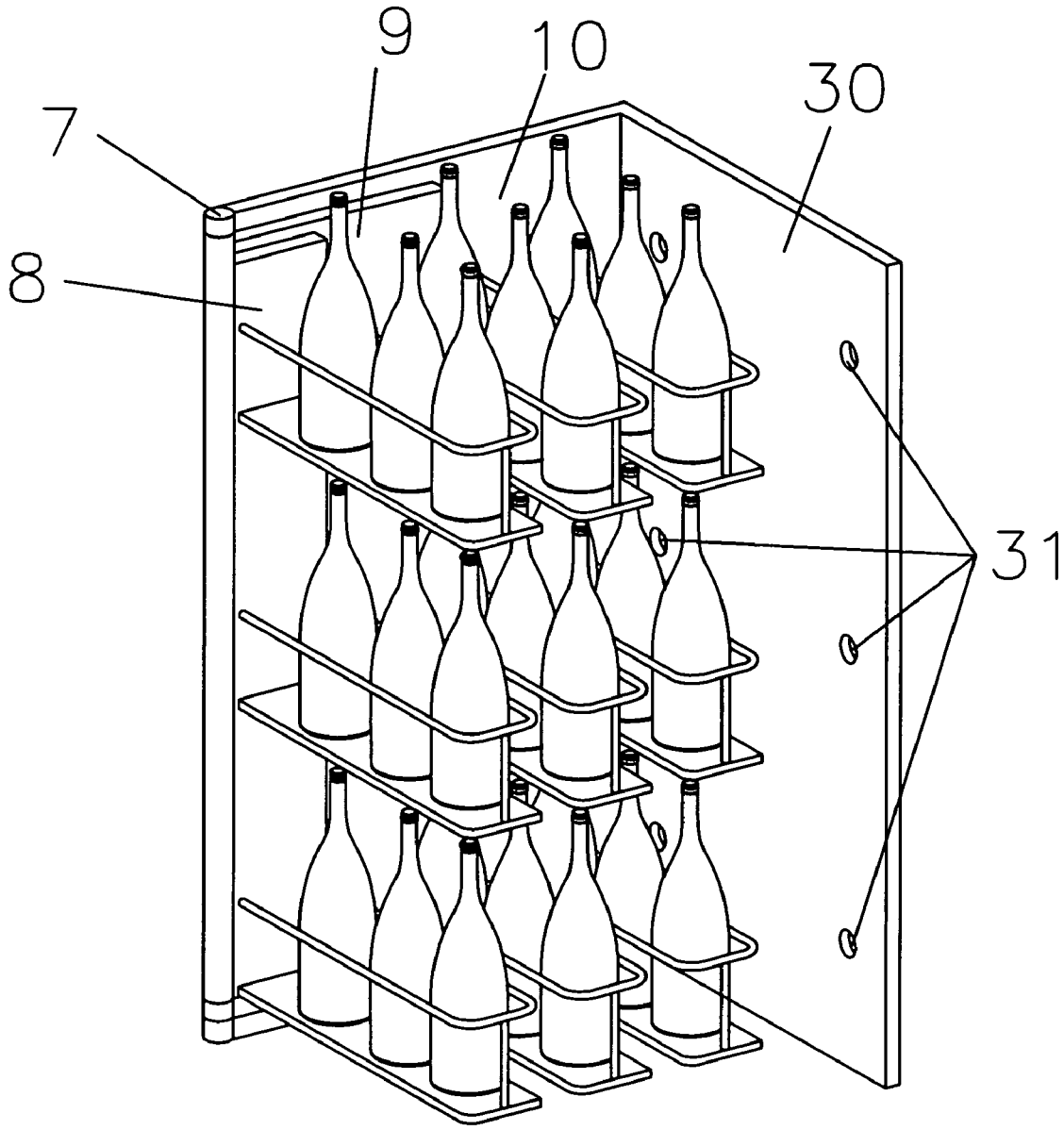
FIG. 8 is a trimetric view further illustrating the invention, showing that the bottles may also be stored in a generally vertical racking system.

FIG. 8 is a trimetric view further illustrating the invention, showing that the bottles may also be stored in a generally vertical racking system. Also of note in FIG. 8 is the "L" bracket panel 30, and mounting holes, 31. As depicted the "L" bracket is formed as a panel oriented 90 degrees to the leaves 8, 9, and 10. In this way, the unit may be mounted to a wall located directly behind the items to be stored. Such an "L" bracket may be integrally formed as shown, or may be a separate bracket added to the racking system. If it is integral, it may as depicted, make the final leaf/rack, in this case leaf/rack 10, fixed. Optionally, the "L" bracket may be on its own increment with respect to the other leaves/racks and the pivot 7, so that all content carrying leaves/racks may swing. Of course, if the unit is to be mounted to a wall to the side of the unit, leaf 10, or a structure associated with leaf 10, or the pivot 7, as has already been described, may be used for mounting. Here again, it may or may not be desirable for the final leaf to be able to swing. Additionally these attachment methods may be applicable to all embodiments of the invention.

Figure 9:
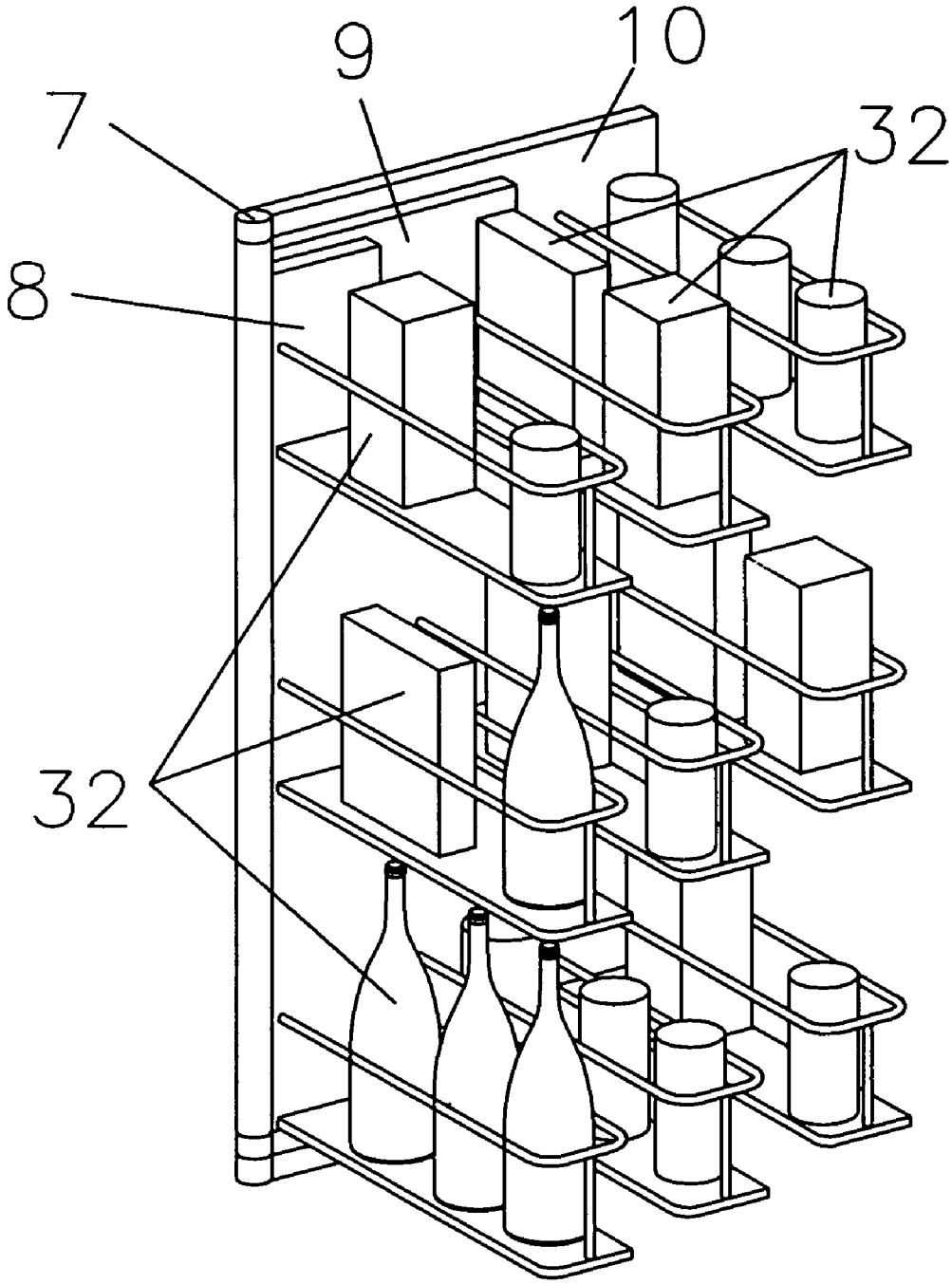
FIG. 9 is a trimetric view further illustrating the invention showing that various items in addition to bottles are also contemplated.

FIG. 9 is a trimetric view further illustrating the invention showing that various items in addition to bottles are also contemplated. FIGS. 8 and/or 9 also contemplate using any of the aforementioned embodiment options of pivot point locations, wall mounting, use within a cabinet, refrigerated or not, etc.

Referring to FIG. 10 a trimetric view can be seen further illustrating the previously stated element that that one of the pivot points of the device may be in the same pivot axis plane as the door of a cabinet, or the very same pivot-hinge of the door of a cabinet. As can be seen in FIG. 10, the door 29 can be provided with support structures 3, specifically designed to support bottles 2 properly in a horizontal manner and the entire structure may pivot about pivot 7. Furthermore, as previously discussed, the other support structures of the invention, still disposed within the cabinet, may share this pivot 7, or may have their own separate pivot axis.

Figure 11:
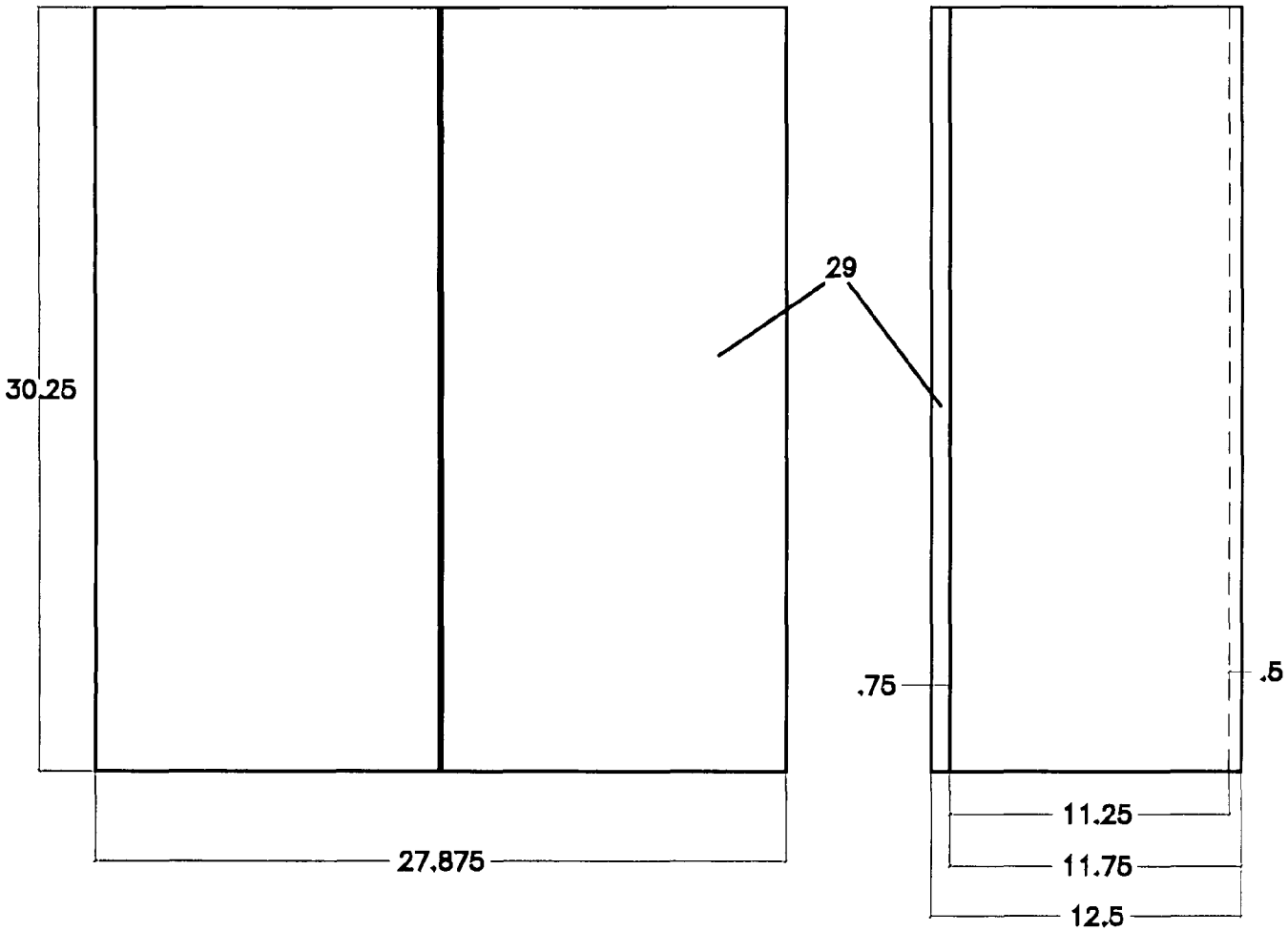
FIG. 11 is a front and side orthographic view of common, upper (above the waist) cabinetries' exterior dimensions.

Referring now to FIG. 11 which is a front and side orthographic view of common, upper (above the waist) cabinetries and the associated exterior dimensions of such a cabinet. There are standard sizes of cabinets used throughout the world. In the United States these are normally expressed in inches, however sometimes metric units are used. In any case, there are general, common sizes that are mixed and matched to accommodated the various spaces and needs of the consumer. In upper cabinets a variety of heights are used. For example a given cabinet may be available in 12, 15, 18, 21, 24, 30, 36, and 42 inches high. At the same time it may be available in as many varying widths such as 9, 12, 15, 18, 21, 24, 27, 32, 36, and 42 inches wide and as a single or double doored unit. The depths of upper and lower cabinets are usually more limited. With the depths of upper cabinets usually being about 12 inches when used above a work surface or counter and about 24 inches when used above base cabinets. Base cabinets are usually 24 inches in depth from their door or drawer front face to the side opposite. All of these dimensions are approximate, as they vary from fractions of an inch to inches from manufacturer to manufacturer and from whether the dimension is inclusive of the door or drawer front, and even depending on the door or drawer style. And custom sizing is always possible when needed. That said, there are ranges that are normally adhered to worldwide. This is because there is a commonality of ergonomics and variety of spaces to be filled worldwide. So whether the sizes are expressed in inches or metric centimeters, there is a commonality of ranges that these cabinets fall within. It is the intention of some of the embodiments of this invention to be able to be used within, or alongside these of cabinets and their associated accepted range of sizes.

Figure 12:
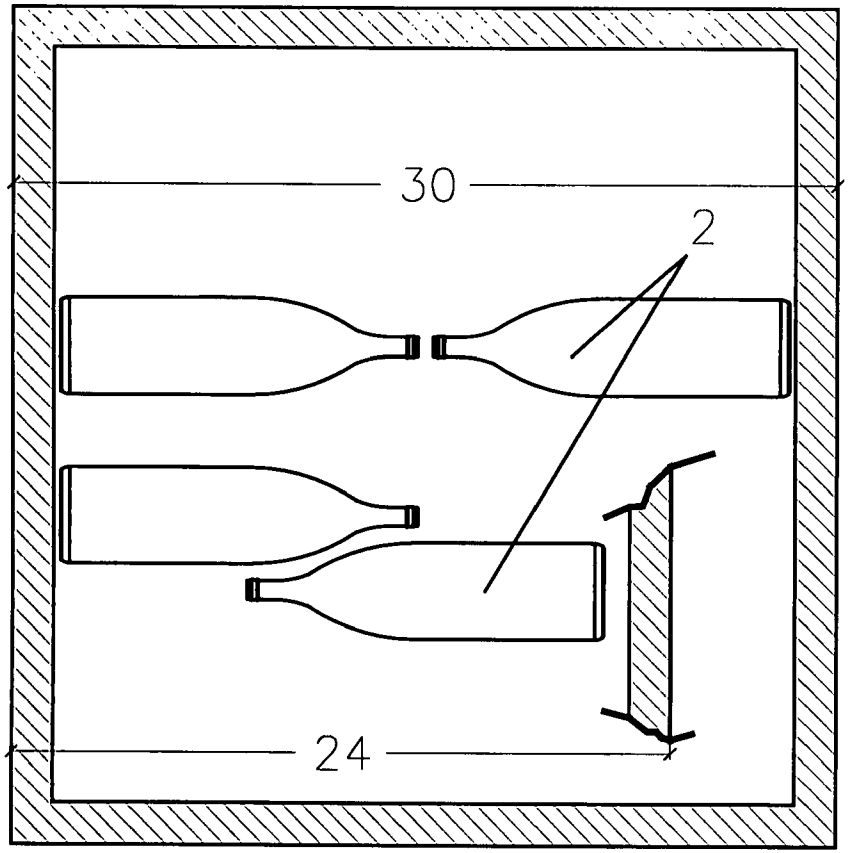
FIG. 12 is a front orthographic sectional view showing two possible dimensional stack-ups of the elements necessary for the proper storage of bottles within a climate controlled cabinet.

Referring to FIG. 12 a front orthographic sectional view showing two possible dimensional stack-ups of the elements necessary for the proper storage of bottles within a climate controlled cabinet can be seen. Wine bottles also come in a variety of sizes and shapes, but here too there are some accepted ranges. Two of the most common sizes are: a bottle that is approximately 3 inches in diameter and 12 inches tall which holds approximately 750 milliliters of fluid and secondly a bottle which is approximately 3.75 inches in diameter, 13.5 inches tall and holds approximately 1500 milliliters of fluid. If the bottles, in this case wine, are to be stored properly on their sides, in an upper cabinet they must be laid in the orientation as shown (and not 90 degrees to that shown but still on their sides). As can be seen, by referring back to FIG. 11, the height of the shorter bottle, approximately 12 inches, exceeds the normal approximate interior dimensions (from the inside of the door to the inside back wall) of a cabinet of approximately 11.25 inches. As can be seen when two of the devices are to be used next to each as in FIG. 12, as well as FIGS. 4, 6, 7 and 10 the stacks may be placed end to end. Of note in FIG. 12 is that the bottles may be nested with regard to their necks and thus save space with regard to the width required of the cabinet. This can be seen in the lower two bottles depicted. In this case 6 inches was saved, an overall dimension of 24 inches versus 30 inches depicted by the two upper, end-to-end bottles. One embodiment of the invention makes provisions for the bottles to be supported in just such a manner so that when two stacks are to be used side by side the bottles may nest in the fashion shown in FIG. 12 for the reasons previously outlined.

Figure 13:
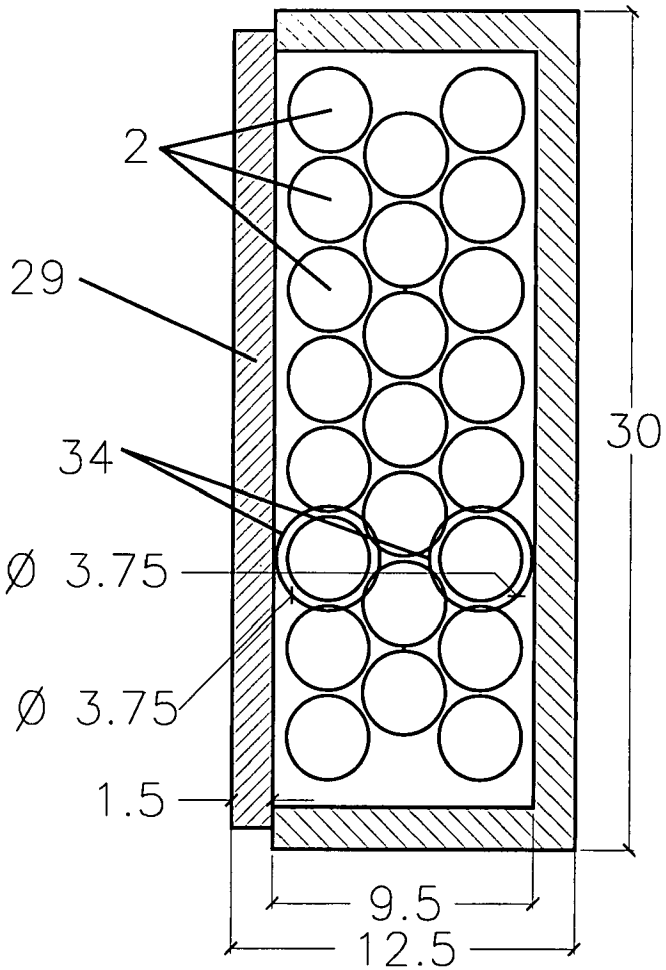
FIG. 13 is a side orthographic sectional view showing one possible dimensional stack-up of the elements necessary for the proper storage of bottles within a climate controlled cabinet.

As we will see, the previously mentioned dimensional constraints only worsen when the climate control includes insulating the walls of the cabinet for efficiency in temperature management. As the most cost effective insulation normally comes with the price of increased thickness. Referring to FIG. 13 is a side orthographic sectional view showing one possible dimensional stack-up of the elements necessary for the proper storage of bottles within an insulated, climate controlled cabinet can be seen. The door and the walls are all depicted at 1.5 inches although thicker or thinner insulated walls could be used. Generally speaking, such walls would be in the 0.25 to 4 inch thick range, and more commonly in the 1 to 2 inch thick range. So, again referring to FIG. 13, it can be seen that you can only get three, 3 inch diameter bottles in the depth of a standard overhead cabinet efficiently. Of note is another other form of nesting that can occur between the circumferences of the bottles. This form of nesting can also be clearly seen in FIGS. 1-6. While the smaller bottles (3 inch diameter) would have fit tangency of one bottle to tangency of the next in the scenario of FIGS. 11 and 13, the space that this nesting gains can be effectively used. One such use in spacing of the bottles for proper air-circulation. This (air circulation) is also why many of the depicted embodiments use a wire-like support structure 3. Another use of this gained space is this enables the larger commonly sized bottle to be accommodated. Referring to FIG. 13 again, the larger bottles depicted by circumference outline of a larger bottle 34, can be accommodated by either not putting a bottle between them or by using thinner insulation than is depicted. In FIG. 11, the 3 larger bottles would just barely fit tangency to tangency 3×3.75 or the 11.25 interior dimension of the cabinet in FIG. 11. However, given the realities of dimensional tolerances, manufacturing and otherwise and the fact that there would be no air flow, and little provision for insulation, this number of bottles of this dimension in this orientation would be unacceptable. So in any case the fact that the bottles of FIG. 13 may be nested is a significant space saver with significant implications. While much of this discussion has been based on upper or "overhead" cabinetry, the invention at hand and the advantages outlined in all the embodiments are equally applicable to what is known as base cabinetry or below the waist cabinetry as well as the freestanding embodiments already outlined.

Thus several improved methods and means of storing and retrieving bottles of wine, other bottles of fluid, or other items has been disclosed.

I claim:

1. A bottle storage device defining a storage space useful for containing multiple wine bottles, the storage space having a front and a back with access to the storage space from the front, the bottle storage device comprising:

a normally stationary support;

a first hinge leaf:

the first hinge leaf being supported by a first pivot defining a generally vertical first pivot axis, the first hinge leaf being pivotable with respect to the normally stationary support, and the first pivot axis being located in a fixed position with respect to the normally stationary support, the first hinge leaf having a proximal portion adjacent to the first pivot axis, the first hinge leaf having a distal portion radially further from the first pivot axis than its proximal portion, the proximal and distal portions of the first hinge leaf defining the plane of the first hinge leaf, and the first hinge leaf being rotatable about the first pivot axis between a first position, with its distal portion closer to the back of the storage space than its proximal portion and the plane of the first hinge leaf generally perpendicular to the front, and a second position with the distal portion displaced forward of its first position;

an elongated first wine bottle support supported by the first hinge leaf, projecting generally perpendicularly in its direction of elongation from the plane of the first hinge leaf, and configured for supporting at least two wine bottles each having a mouth and a base, such that the wine bottles respectively are elongated along first and second wine bottle axes extending between the mouth and the base, with each wine bottle axis extending generally perpendicularly from the plane of the first hinge leaf and the first wine bottle axis disposed above and parallel to the second wine bottle axis;

a second hinge leaf:

the second hinge leaf being supported by a second pivot defining a generally vertical second pivot axis spaced from the first pivot axis, the second hinge leaf being pivotable with respect to the normally stationary support, the second pivot axis being located in a fixed position with respect to the normally stationary support, the second hinge leaf having a proximal portion adjacent to the second pivot axis, the second hinge leaf having a distal portion radially further from the second pivot axis than its proximal portion, the proximal and distal portions of the second hinge leaf defining the plane of the second hinge leaf, and the second hinge leaf being rotatable about the second pivot axis between a first position with its distal portion closer to the back of the storage space than its proximal portion and the plane of the second hinge leaf generally perpendicular to the front, and a second position with the distal portion displaced forward of its first position; and an elongated second wine bottle support supported by the second hinge leaf, projecting generally perpendicularly in its direction of elongation from the plane of the second hinge leaf, and configured for supporting a wine bottle having a mouth and a base, the wine bottle being elongated along a bottle axis extending between the mouth and the base, with the bottle axis extending generally perpendicularly from the plane of the second hinge leaf;

in which the second wine bottle support is between the first wine bottle support and the back of the storage space when the first and second hinge leaves are in their first positions.

2. The bottle storage device of claim 1, further comprising at least two opposed, generally parallel walls defining the storage space between them.

3. The bottle storage device of claim 2, in which the walls comprise an upper wall and a lower wall.

4. The bottle storage device of claim 2, in which the walls comprise left and right side walls.

5. The bottle storage device of claim 4, in which the walls further comprise top and bottom side walls.

6. The bottle storage device of claim 5, further comprising a door covering at least a portion of the front of the storage space.

7. The bottle storage device of claim 2, in which the first pivot is supported by at least one of the walls.

8. The bottle storage device of claim 1, in which the second position of the distal portion of the first hinge leaf is at least as far forward as the first pivot axis.

9. The bottle storage device of claim 1, in which the second position of the distal portion of the first hinge leaf is forward of its pivot axis.

10. The bottle storage device of claim 1, in which the second position of the distal portion of the first hinge leaf extends forward outside the storage space.

11. The bottle storage device of claim 1, in which the planes of the first and second leaves in their first positions are generally coplanar.

12. The bottle storage device of claim 1, in which the first and second pivot axes are non-collinear and define a plane perpendicular to the front of the storage space.

13. The bottle storage device of claim 1, in which the first and second pivot axes are collinear.

14. The bottle storage device of claim 1, further comprising:

a third hinge leaf:

the third hinge leaf being supported by a third pivot defining a generally vertical third pivot axis spaced from the first pivot axis, the third hinge leaf having a proximal portion adjacent to the third pivot axis, the third hinge leaf having a distal portion radially further from the third pivot axis than its proximal portion, the proximal and distal portions of the third hinge leaf defining the plane of the third hinge leaf, and the third hinge leaf being rotatable about the third pivot axis between a first position, with its distal portion closer to the back of the storage space than its proximal portion and the plane of the third hinge leaf generally perpendicular to the front, and a second position with the distal portion displaced forward of its first position; and an elongated third wine bottle support supported by the third hinge leaf, projecting generally perpendicularly in its direction of elongation from the plane of the third hinge leaf, and configured for supporting a wine bottle having a mouth and a base, the wine bottle being elongated along a bottle axis extending between the mouth and the base, with the bottle axis extending generally perpendicularly from the plane of the first hinge leaf.

15. The bottle storage device of claim 14, in which the second and third pivot axes are collinear.

16. The bottle storage device of claim 14, in which the second and third pivot axes are non-collinear and lie in a plane generally perpendicular to the front of the storage space.

17. The bottle storage device of claim 1, in which the first bottle support comprises first and second generally horizontally spaced rods having first ends secured to the first hinge leaf and second ends projecting generally perpendicularly from the first hinge leaf.

18. The bottle storage device of claim 17, in which the first and second generally horizontally spaced rods are positioned and sized to support a generally cylindrical elongated bottle generally horizontally on top of and between them with the rods located above the lower horizontal side wall portion of the bottle at the greatest diameter of the bottle and below and proximal of the vertical side wall portions of the bottle at the greatest diameter of the bottle.

19. The bottle storage device of claim 1, comprising a third bottle support secured to the first hinge leaf for supporting a generally cylindrical elongated bottle below the first bottle support with the third bottle axis generally parallel to the axis of a bottle supported in the first bottle support.

20. The bottle storage device of claim 19, comprising a fourth bottle support secured to the second hinge leaf for supporting a generally cylindrical elongated bottle below the second bottle support with the fourth bottle axis generally parallel to the axis of a bottle supported in the second bottle support.

21. The bottle storage device of claim 20, in which the second and fourth bottle supports are located behind the first and third bottle supports.

22. The bottle storage device of claim 20, in which the second and fourth bottle supports are vertically staggered with respect to the first and third bottle supports.

23. A bottle storage cabinet comprising:

joined left and right side panels and top and bottom panels defining an enclosure, a normally stationary support, and a front opening;

a first hinge leaf defining a first plane, the first hinge leaf supported by a first pivot defining a generally vertical first pivot axis, the first hinge leaf being pivotable with respect to the normally stationary support, and the first pivot axis being located in a fixed position with respect to the normally stationary support, the first hinge leaf supporting an elongated first wine bottle support projecting generally perpendicularly in its direction of elongation from the plane of the first hinge leaf, and configured for supporting a wine bottle having a mouth at one end and a base at the other end, the wine bottle being elongated along a wine bottle axis extending between the mouth and the base, with the wine bottle axis extending generally perpendicularly from the plane of the first hinge leaf, the first hinge leaf being rotatable about the first pivot axis to move the first wine bottle support between a first position supporting the bottle within the enclosure and perpendicular to the side panels, and a second position supporting the bottle with at least one of its ends projecting out of the enclosure through the front opening; and a second hinge leaf defining a second plane, the second hinge leaf supported by a second pivot defining a generally vertical second pivot axis spaced from the first pivot axis, the second hinge leaf being pivotable with respect to the normally stationary support, and the second pivot axis being located in a fixed position with respect to the normally stationary support, the second hinge leaf supporting an elongated second wine bottle support projecting generally perpendicularly in its direction of elongation from the plane of the second hinge leaf, and configured for supporting a wine bottle having a mouth at one end and a base at the other end, the wine bottle being elongated along a wine bottle axis extending between the mouth and the base, with the wine bottle axis extending generally perpendicularly from the plane of the second hinge leaf, the second hinge leaf being rotatable about the second pivot axis to move the second wine bottle support between a first position supporting the bottle within the enclosure and perpendicular to the side panels, and a second position supporting the bottle with at least one of its ends projecting out of the enclosure through the front opening in which the second wine bottle support is between the first wine bottle support and the back of the storage space when the first and second hinge leaves are in their first positions.

24. A bottle storage kit suitable for installation in a storage space, the storage space having a front and a back with access to the storage space from the front, the storage space defined at least in part by a normally stationary support, the kit comprising:

a first hinge leaf having a proximal portion and a distal portion, the proximal and distal portions of the first hinge leaf defining the plane of the first hinge leaf;

an elongated first wine bottle support supported by the first hinge leaf, projecting generally perpendicularly in its direction of elongation from the plane of the first hinge leaf, and configured for supporting a wine bottle having a mouth, a base, and a wine bottle axis extending between the mouth and the base, with the wine bottle axis extending generally perpendicularly from the plane of the first hinge leaf;

a first pivot mountable in a fixed position with respect to the normally stationary support in the storage space for supporting the first hinge leaf by a generally vertical first pivot axis, such that, the first hinge leaf proximal portion is adjacent to the first pivot axis, the first hinge leaf distal portion is radially further from the first pivot axis than its proximal portion, and the first hinge leaf is rotatable about the first pivot axis between a first position, with its distal portion closer to the back of the storage space than its proximal portion and the plane of the first hinge leaf generally perpendicular to the front, and a second position with the distal portion displaced forward of its first position;

a second hinge leaf having a proximal portion and a distal portion, the proximal and distal portions of the second hinge leaf defining the plane of the second hinge leaf;

an elongated second wine bottle support supported by the second hinge leaf, projecting generally perpendicularly in its direction of elongation from the plane of the second hinge leaf, and configured for supporting a wine bottle having a mouth, a base, and a wine bottle axis extending between the mouth and the base, with the wine bottle axis extending generally perpendicularly from the plane of the second hinge leaf;

a second pivot mountable in a fixed position with respect to the normally stationary support in the storage space for supporting the second hinge leaf by a generally vertical second pivot axis spaced from the first pivot axis, such that, the second hinge leaf proximal portion is adjacent to the second pivot axis the second hinge leaf distal portion is radially further from the second pivot axis than its proximal portion, and the second hinge leaf is rotatable about the second pivot axis between a first position, with its distal portion closer to the back of the storage space than its proximal portion and the plane of the second hinge leaf generally perpendicular to the front, and a second position with the distal portion displaced forward of its first position in which the second wine bottle support is between the first wine bottle support and the back of the storage space when the first and second hinge leaves are in their first positions.

* * * * *